US009546628B2

(12) United States Patent
Sanborn et al.

(10) Patent No.: US 9,546,628 B2
(45) Date of Patent: Jan. 17, 2017

(54) IDENTIFYING FUEL SYSTEM DEGRADATION

(71) Applicant: Ford Global Technologies, LLC, Dearborn, MI (US)

(72) Inventors: Ethan D. Sanborn, Saline, MI (US); Pankaj Kumar, Dearborn, MI (US); Imad Hassan Makki, Dearborn Heights, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 248 days.

(21) Appl. No.: 14/558,295

(22) Filed: Dec. 2, 2014

(65) Prior Publication Data

US 2016/0153388 A1 Jun. 2, 2016

(51) Int. Cl.

| | |
|---|---|
| ***F02D 41/38*** | (2006.01) |
| ***F02M 39/00*** | (2006.01) |
| ***F02D 41/22*** | (2006.01) |
| ***F02M 65/00*** | (2006.01) |
| *F02D 41/30* | (2006.01) |

(52) U.S. Cl.

CPC ..... *F02M 39/00* (2013.01); *F02D 41/22* (2013.01); *F02D 41/3854* (2013.01); *F02M 65/00* (2013.01); *F02D 41/221* (2013.01); *F02D 41/222* (2013.01); *F02D 41/3082* (2013.01); *F02D 2200/0602* (2013.01); *F02D 2250/02* (2013.01); *F02M 2200/247* (2013.01)

(58) Field of Classification Search

CPC .. F02D 41/38; F02D 41/3845; F02D 41/2082; F02D 41/04; F02D 41/22; F02D 41/3854; F02D 41/222

See application file for complete search history.

(56) References Cited

U.S. PATENT DOCUMENTS

| | | | |
|---|---|---|---|
| 3,822,677 | A | 7/1974 | Reddy |
| 3,967,598 | A | 7/1976 | Rachel |

(Continued)

FOREIGN PATENT DOCUMENTS

| | | | |
|---|---|---|---|
| EP | 2434137 | B1 | 7/2013 |
| WO | 2014031400 | A1 | 2/2014 |

OTHER PUBLICATIONS

Pursifull, Ross D., "System and Method for Operating an Engine Combusting Liquefied Petroleum Gas," U.S. Appl. No. 13/970,519, filed Aug. 19, 2013, 30 pages.

(Continued)

*Primary Examiner* — Hieu T Vo

(74) *Attorney, Agent, or Firm* — Julia Voutyras; Alleman Hall McCoy Russell & Tuttle LLP

(57) ABSTRACT

Various methods are thus provided for identifying degradation in a fuel system. In one embodiment, a method of operating a fuel system comprises applying a pulse to a fuel pump responsive to detecting that lift pump pressure corresponds to a fuel vapor pressure, ceasing application of the pulse responsive to detecting that the lift pump pressure corresponds to a relief setpoint pressure, and indicating degradation in the fuel system if the detected lift pump pressure deviates from an expected fuel rail pressure, including distinguishing among degradation in the fuel pump, a lower pressure fuel pressure sensor, a fuel rail pressure sensor, and a pressure relief valve.

20 Claims, 7 Drawing Sheets

(56) References Cited

U.S. PATENT DOCUMENTS

| | | | | |
|---|---|---|---|---|
| 5,477,833 | A | 12/1995 | Leighton | |
| 5,878,727 | A | 3/1999 | Huls | |
| 5,884,610 | A | 3/1999 | Reddy | |
| 5,937,826 | A | 8/1999 | Olson et al. | |
| 6,024,064 | A | 2/2000 | Kato et al. | |
| 6,138,638 | A | 10/2000 | Morikawa | |
| 6,142,747 | A | 11/2000 | Rosenau et al. | |
| 6,196,203 | B1 | 3/2001 | Grieve et al. | |
| 6,622,708 | B2 * | 9/2003 | Braun | F02D 33/003 123/179.17 |
| 6,694,950 | B2 | 2/2004 | Djordjevic | |
| 6,854,321 | B2 | 2/2005 | Amlin | |
| 6,964,262 | B2 | 11/2005 | Hayakawa | |
| 6,988,488 | B2 | 1/2006 | Pursifull et al. | |
| 7,025,050 | B2 | 4/2006 | Oono et al. | |
| 7,059,313 | B2 | 6/2006 | Lippa | |
| 7,128,057 | B2 | 10/2006 | Wiese et al. | |
| 7,272,485 | B2 | 9/2007 | Amano et al. | |
| 7,640,916 | B2 | 1/2010 | Ulrey et al. | |
| 7,759,010 | B2 | 7/2010 | Hoch | |
| 7,832,375 | B2 | 11/2010 | Dusa et al. | |
| 7,886,720 | B2 | 2/2011 | Graf | |
| 8,061,329 | B2 | 11/2011 | Pursifull et al. | |
| 8,483,932 | B2 | 7/2013 | Pursifull | |
| 8,776,764 | B2 | 7/2014 | Basmaji et al. | |
| 9,200,600 | B1 * | 12/2015 | Taylor | F02M 25/08 |
| 9,334,824 | B2 * | 5/2016 | Pursifull | F02D 41/008 |
| 2001/0029925 | A1 | 10/2001 | Ferry et al. | |
| 2002/0170539 | A1 | 11/2002 | Rembold et al. | |
| 2005/0257779 | A1 | 11/2005 | Knight et al. | |
| 2009/0090331 | A1 | 4/2009 | Pursifull | |
| 2010/0332108 | A1 | 12/2010 | Kato et al. | |
| 2011/0106393 | A1 | 5/2011 | Pursifull | |
| 2011/0209687 | A1 | 9/2011 | Schroeder et al. | |
| 2013/0061830 | A1 | 3/2013 | Hornby et al. | |
| 2013/0138325 | A1 | 5/2013 | Lee | |
| 2014/0109875 | A1 | 4/2014 | Lachaize | |
| 2014/0120440 | A1 | 5/2014 | Nolan et al. | |
| 2014/0224217 | A1 | 8/2014 | Pursifull et al. | |
| 2014/0230794 | A1 | 8/2014 | Surnilla et al. | |
| 2014/0297071 | A1 | 10/2014 | Dudar et al. | |
| 2015/0027416 | A1 | 1/2015 | Brostrom et al. | |
| 2016/0177861 | A1 * | 6/2016 | Ulrey | F02D 41/3854 123/294 |

OTHER PUBLICATIONS

Pursifull, Ross D. et al., "High Pressure Fuel Pump Control for Idle Tick Reduction," U.S. Appl. No. 14/042,971, filed Oct. 1, 2013, 34 pages.

Surnilla, Gopichandra et al., "Adaptive Learning of Duty Cycle for a High Pressure Fuel Pump," U.S. Appl. No. 14/099,615, filed Dec. 6, 2013, 44 pages.

Surnilla, Gopichandra et al., "Robust Direct Injection Fuel Pump System," U.S. Appl. No. 14/155,250, filed Jan. 14, 2014, 61 pages.

Pursifull, Ross D. et al., "Method and System for Characterizing a Port Fuel Injector," U.S. Appl. No. 14/192,768, filed Feb. 27, 2014, 44 pages.

Surnilla, Gopichandra et al., "High Pressure Fuel Pumps with Mechanical Pressure Regulation," U.S. Appl. No. 14/243,615, filed Apr. 2, 2014, 53 pages.

Ulrey, Joseph N. et al., "Adjusting Pump Volume Commands for Direct Injection Fuel Pumps," U.S. Appl. No. 14/300,162, filed Jun. 9, 2014, 42 pages.

Ulrey, Joseph N. et al., "Current Pulsing Control Methods for Lift Fuel Pumps," U.S. Appl. No. 14/444,739, filed Jul. 28, 2014, 48 pages.

Pursifull, Ross D., "Method and System for Supplying Liquefied Petroleum Gas to a Direct Fuel Injected Engine," U.S. Appl. No. 14/532,756, filed Nov. 4, 2014, 39 pages.

Pursifull, Ross D., "Method and System for Fuel System Control," U.S. Appl. No. 14/551,906, filed Nov. 24, 2014, 46 pages.

Ulrey, Joseph N. et al., "Optimizing Intermittent Fuel Pump Control," U.S. Appl. No. 14/558,363, filed Dec. 2, 2014, 44 pages.

Ulrey, Joseph N. et al., "Systems and Methods for Sensing Fuel Vapor Pressure," U.S. Appl. No. 14/558,406, filed Dec. 2, 2014, 43 pages.

Pursifull, Ross D., "Method for Lift Pump Control," U.S. Appl. No. 14/558,482, filed Dec. 2, 2014, 53 pages.

Pursifull, Ross D., "Direct Injection Pump Control," U.S. Appl. No. 14/560,497, filed Dec. 4, 2014, 49 pages.

Surnilla, Gopichandra et al., "Methods and Systems for Fixed and Variable Pressure Fuel Injection," U.S. Appl. No. 14/570,546, filed Dec. 15, 2014, 51 pages.

Anonymous, "Device for Leakage Avoidance from Damaged Plastic Fuel Containment Components," IPCOM No. 000159128, Published Oct. 9, 2007, 3 pages.

* cited by examiner

IDENTIFYING FUEL SYSTEM DEGRADATION

FIELD

The field of the disclosure generally relates to fuel systems in internal combustion engines.

BACKGROUND AND SUMMARY

Lift pump control systems are used for a variety of purposes including vapor management, injection pressure control, temperature control, and lubrication. In one example, a lift pump supplies fuel to a high pressure fuel pump that provides a high injection pressure for direct injectors in an internal combustion engine. The high pressure fuel pump may provide the high injection pressure by supplying high pressure fuel to a fuel rail to which the direct injectors are coupled. A fuel pressure sensor may be disposed in the fuel rail to enable measurement of the fuel rail pressure, on which various aspects of engine operation may be based, such as fuel injection. Degradation in the fuel rail pressure sensor and/or lift pump may cause the fuel rail pressure to deviate from a desired or expected fuel rail pressure, which in turn may result in the injection of undesired fuel quantities, degrading engine operation.

U.S. Pat. No. 7,832,375 discloses systems and methods for addressing fuel pressure uncertainty during engine startup. In particular, a fuel rail pressure sensor may be determined to be in a degraded state if the sensor indicates a fuel rail pressure that deviates from an estimated fuel rail pressure by a predetermined amount. In some examples, the estimated fuel rail pressure is determined based on a lift pump pressure. In response to determining that the fuel rail pressure sensor is operating in a degraded state, the fuel rail pressure may be increased by appropriately operating high and low pressure fuel pumps.

The inventors herein have recognized an issue with the approach identified above. Under some conditions, a difference between a fuel rail pressure measured by a fuel rail pressure sensor and an estimated fuel rail pressure may be the result of degradation in a lift pump, alternatively or additionally to degradation in the fuel rail pressure sensor. Degradation in the operation of a pressure relief valve may also contribute to such a difference. This difference may manifest as the measured fuel rail pressure being less than the estimated fuel rail pressure by a threshold, for example. As such, differences between measured and estimated fuel rail pressures may be interpreted incorrectly, potentially leading to actions being taken that are not intended for the actual cause of the differences.

One approach that at least partially addresses the above issues includes a method of operating a fuel system, comprising applying a pulse to a fuel pump responsive to detecting that lift pump pressure corresponds to a fuel vapor pressure, ceasing application of the pulse responsive to detecting that the lift pump pressure corresponds to a relief setpoint pressure, and indicating degradation in the fuel system if the detected lift pump pressure deviates from an expected lift pump pressure, including distinguishing among degradation in the fuel pump, a lower pressure fuel pressure sensor, a fuel rail pressure sensor, and a pressure relief valve.

In a more specific example, the expected lift pump pressure is determined based on a voltage supplied to the lift pump and a fuel flow rate.

In another aspect of the example, the expected lift pump pressure is the fuel vapor pressure.

In yet another aspect of the example, the expected lift pump pressure is the relief setpoint pressure, and indicating degradation in the fuel system includes, if the detected lift pump pressure exceeds the relief setpoint pressure, assuming a fault in a lower pressure fuel pressure sensor, the fuel rail pressure sensor, and/or the pressure relief valve, and if the detected lift pump pressure is less than the relief setpoint pressure, assuming a fault in the fuel rail pressure sensor, the lower pressure fuel pressure sensor, the pressure relief valve, and/or the fuel pump.

In this way, the cause of degradation in a fuel system can be definitively identified and compensated. Thus, the technical result is achieved by these actions.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Some internal combustion engines employ fuel systems in which a low pressure (LP) fuel pump draws pressurized fuel from a fuel tank and supplies the pressurized fuel to a high pressure (HP) fuel pump, which may further raise the pressure of the pressurized fuel to a level sufficient for directly injecting fuel into the engine cylinders. The LP fuel pump may be referred to as a lift pump, while the HP fuel pump may be referred to as a direct injection (DI) pump. In this example, the HP fuel pump may supply highly pressurized fuel to a fuel rail to which a plurality of fuel injectors configured for direct fuel injection are coupled. A fuel pressure sensor may also be coupled to the fuel rail to enable fuel pressure sensing in the fuel rail. Fuel injection by the fuel injectors may be controlled based on the sensed fuel rail pressure.

Under some conditions, the fuel pressure indicated by such a fuel rail pressure sensor may deviate from an expected fuel pressure. The expected fuel pressure may be determined based on a variety of operating parameters (e.g., lift pump supply voltage, fuel flow rate) as described in further detail below. This deviation may be the result of degradation in the fuel rail pressure sensor. Various approaches exist to identifying fuel pressure sensor degradation based on the deviation of the measured fuel rail pressure from the expected fuel rail pressure, and to compensating the degradation, for example by altering operation of low and high pressure fuel pumps.

Deviation of measured fuel rail pressure from expected fuel pressure may be the result of causes other than fuel rail pressure sensor degradation, however, a possibility for which the approaches identified above cannot account. Alternatively or in addition to sensor degradation, the deviation may be the result of lift pump degradation and/or pressure relief valve degradation, for example.

Figure 1:
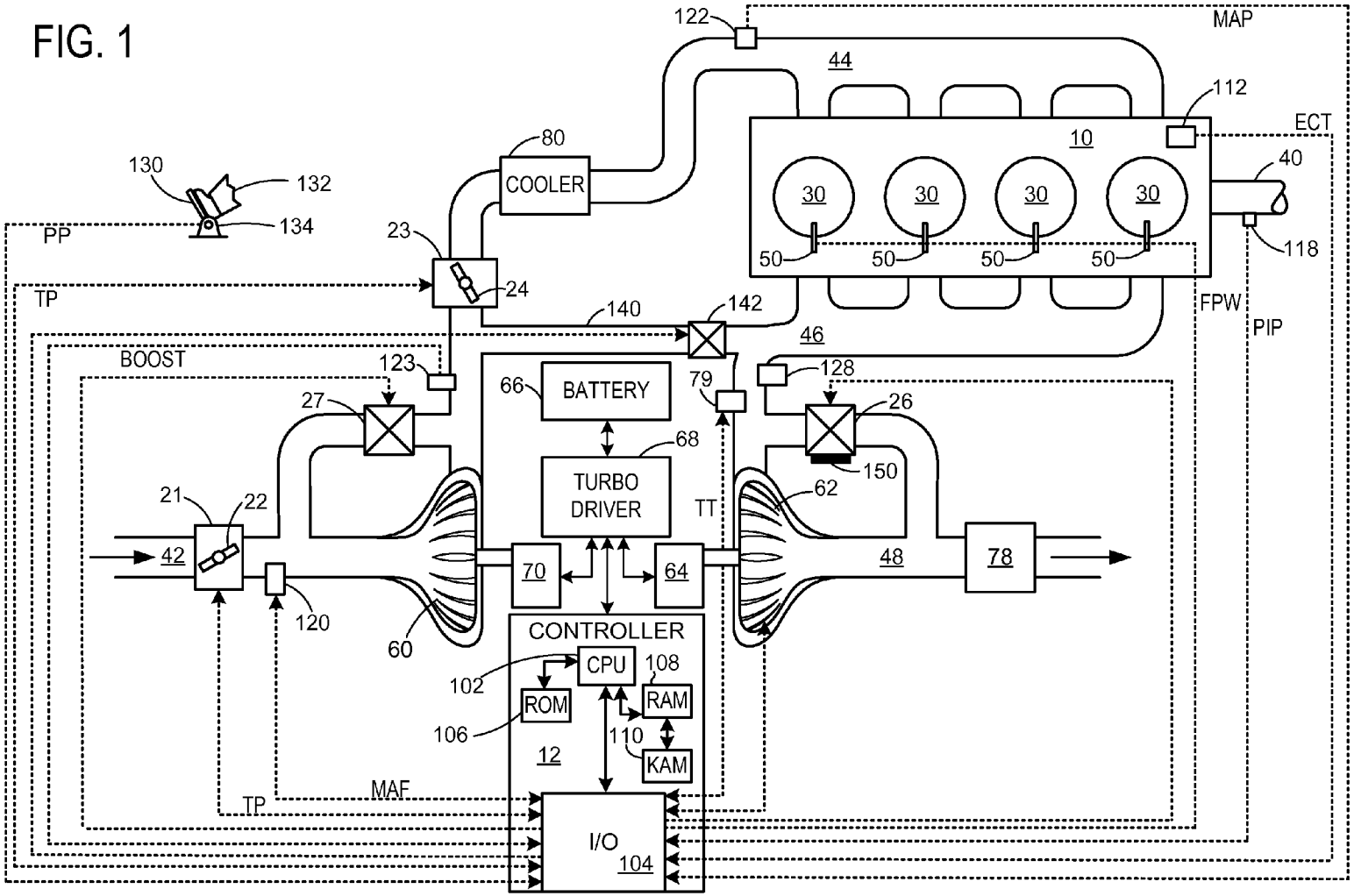
FIG. 1 is a schematic diagram showing an example engine.
Figure 2:
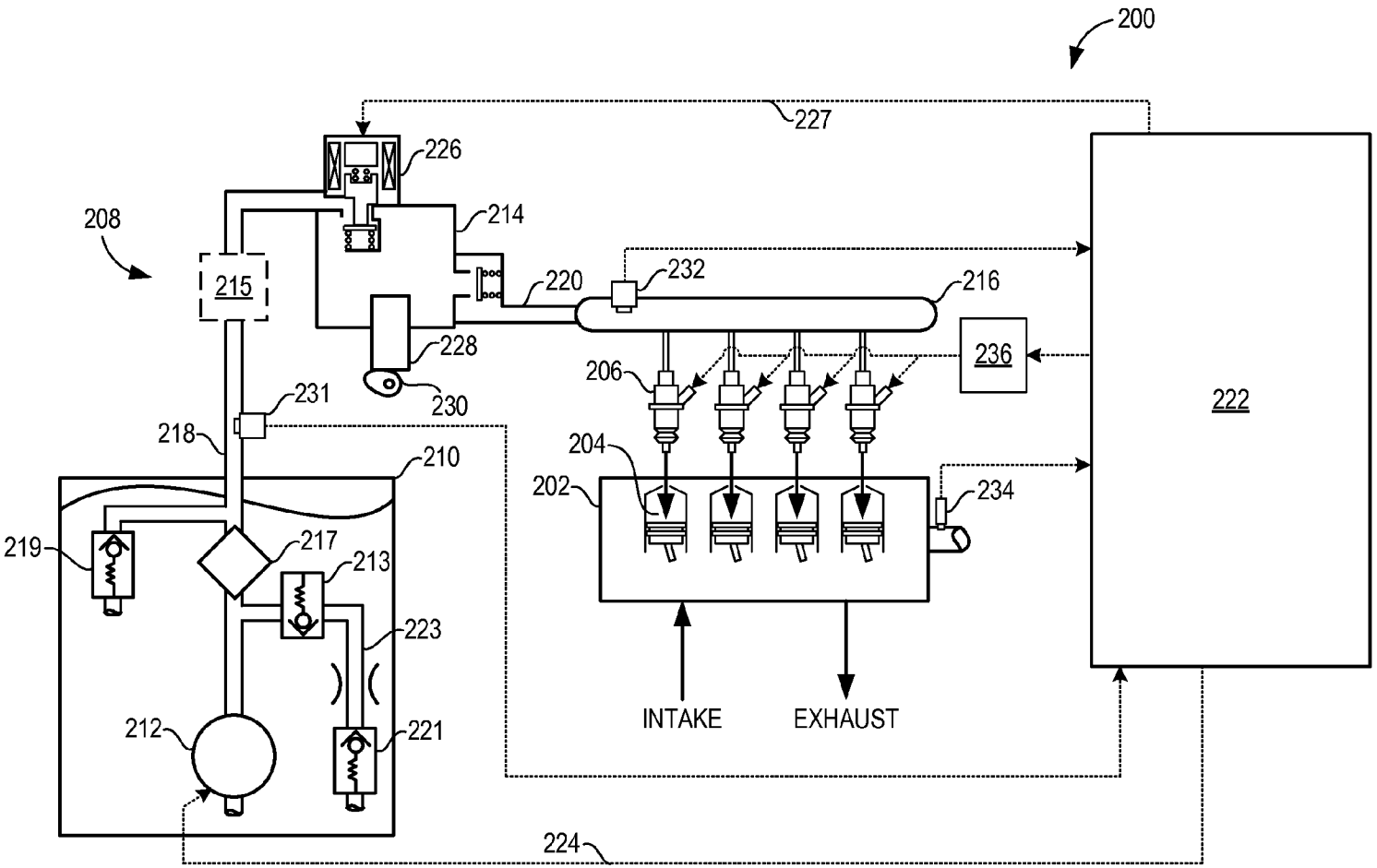
FIG. 2 shows a direct injection engine system.
Figure 3:
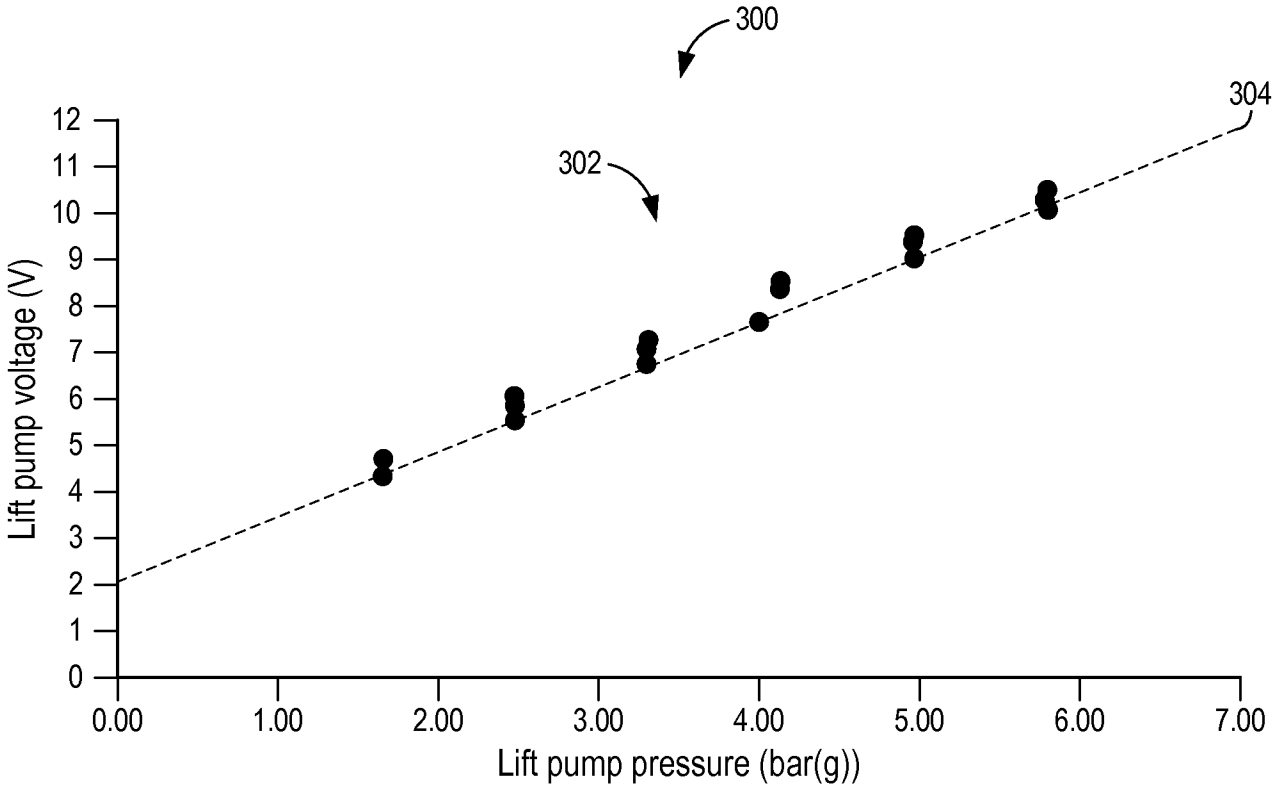
FIG. 3 shows a graph illustrating lift pump voltage as a function of lift pump pressure.
Figure 4:
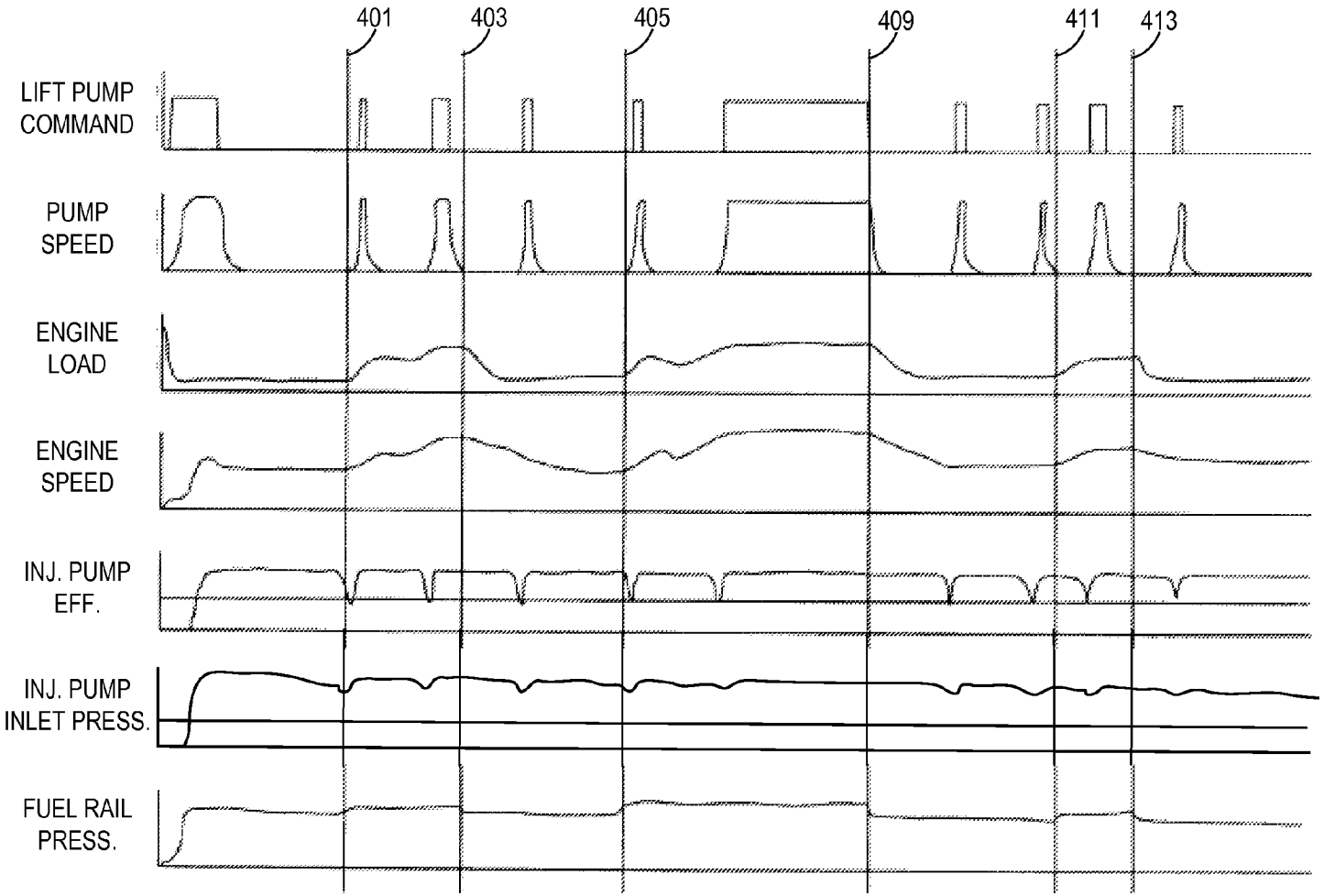
FIG. 4 shows a plot of representative signals of interest when operating a lift pump according to an intermittent operation mode.
Figure 5A:
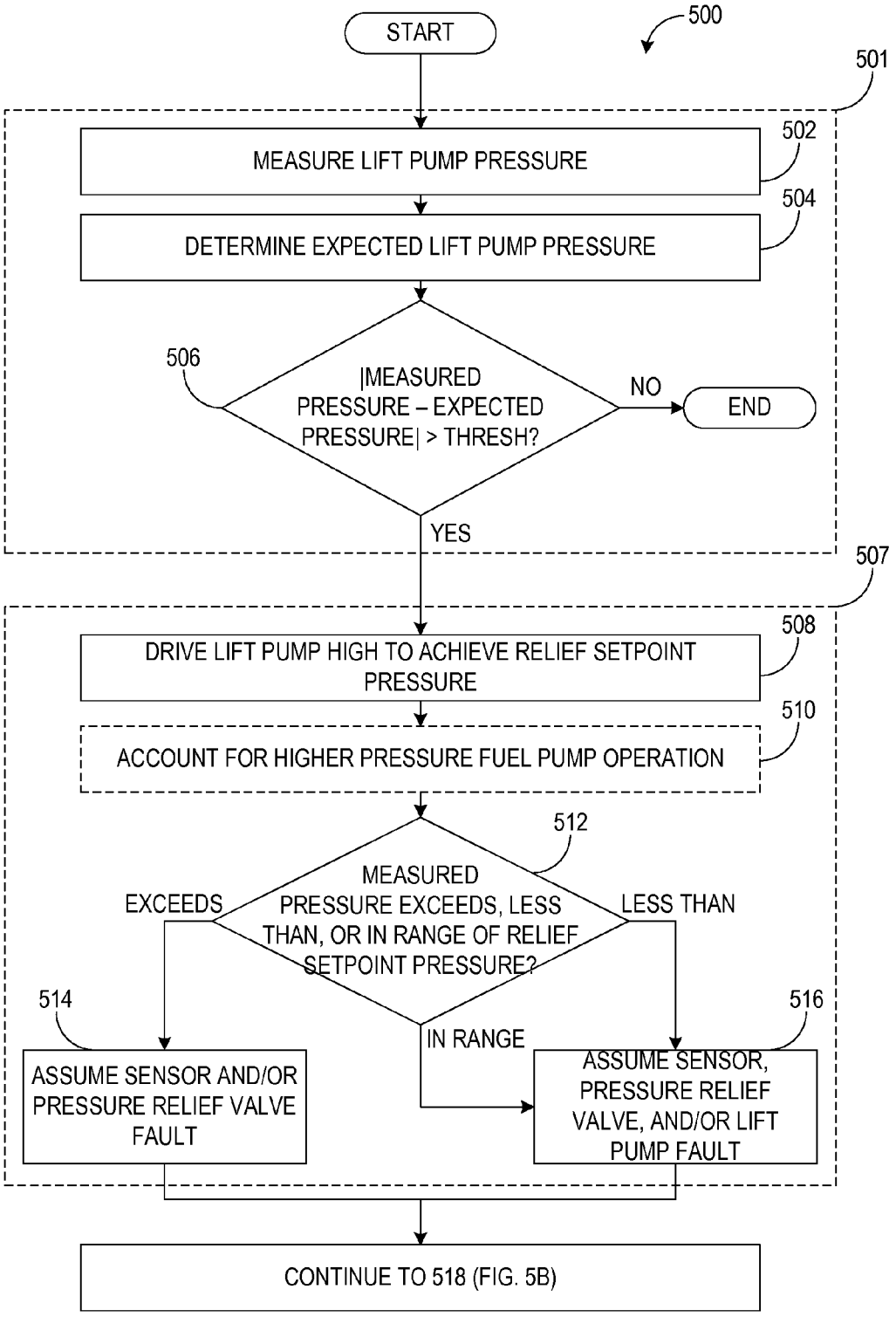
FIGS. 5A and 5B show a flowchart illustrating a routine for identifying degradation in a fuel system.
Figure 5B:
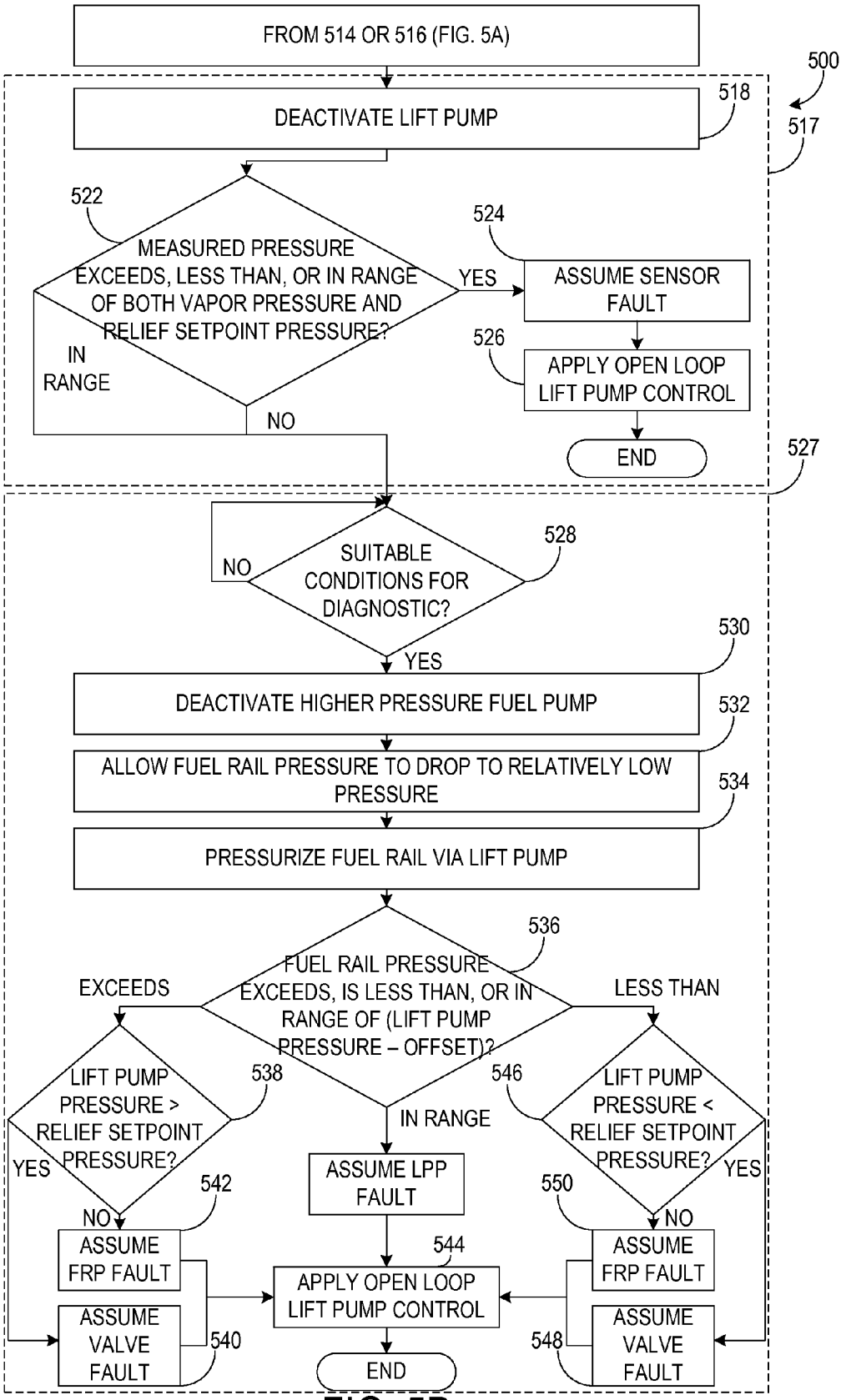
Figure 6:
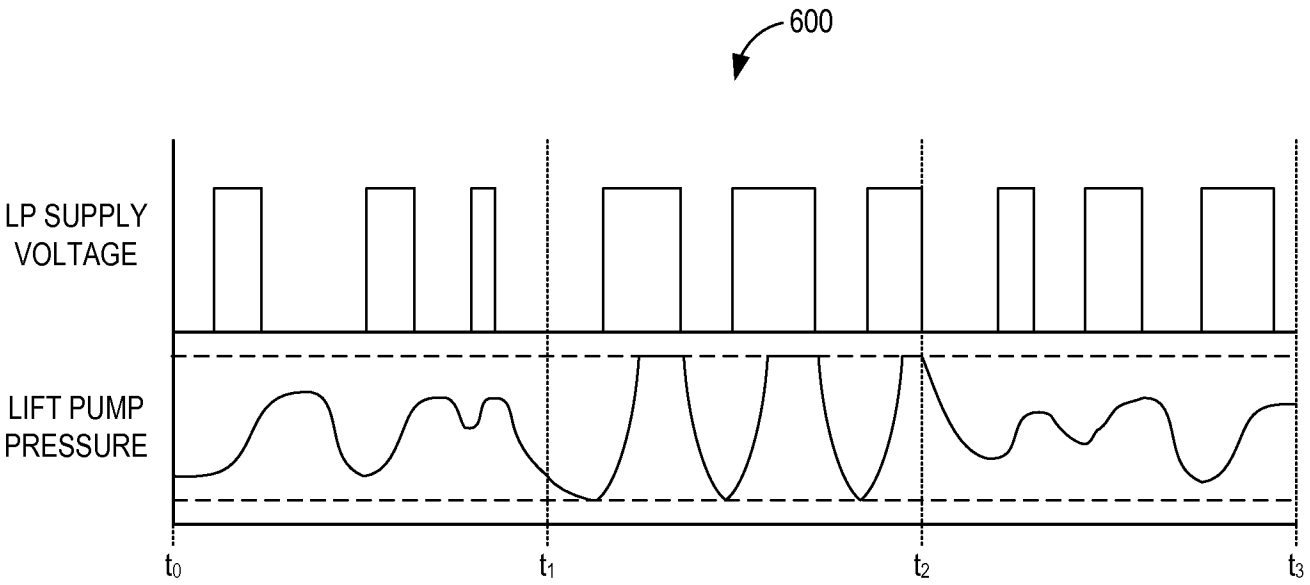
FIG. 6 shows a plot illustrating operation of a fuel system when in a diagnostic mode and a non-diagnostic mode.

Various methods are thus provided for identifying degradation in a fuel system. In one embodiment, a method of operating a fuel system, comprising applying a pulse to a fuel pump responsive to detecting that lift pump pressure corresponds to a fuel vapor pressure, ceasing application of the pulse responsive to detecting that the lift pump pressure corresponds to a relief setpoint pressure, and indicating degradation in the fuel system if the detected lift pump pressure deviates from an expected lift pump pressure, including distinguishing among degradation in the fuel pump, a lower pressure fuel pressure sensor, a fuel rail pressure sensor, and a pressure relief valve. FIG. 1 is a schematic diagram showing an example engine, FIG. 2 shows a direct injection engine system, FIG. 3 shows a graph illustrating lift pump voltage as a function of lift pump pressure, FIG. 4 shows a plot of representative signals of interest when operating a lift pump according to an intermittent operation mode, FIGS. 5A and 5B show a flowchart illustrating a routine for identifying degradation in a fuel system, and FIG. 6 shows a plot illustrating operation of a fuel system when in a diagnostic lode and a non-diagnostic mode. The engines of FIGS. 1 and 2 include controllers configured to carry out the method depicted in FIGS. 5A and 5B.

FIG. 1 is a schematic diagram showing an example engine 10, which may be included in a propulsion system of an automobile. The engine 10 is shown with four cylinders 30. However, other numbers of cylinders may be used in accordance with the current disclosure. Engine 10 may be controlled at least partially by a control system including controller 12, and by input from a vehicle operator 132 via an input device 130. In this example, input device 130 includes an accelerator pedal and a pedal position sensor 134 for generating a proportional pedal position signal PP. Each combustion chamber (e.g., cylinder) 30 of engine 10 may include combustion chamber walls with a piston (not shown) positioned therein. The pistons may be coupled to a crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel to enable a starting operation of engine 10.

Combustion chambers 30 may receive intake air from intake manifold 44 via intake passage 42 and may exhaust combustion gasses via exhaust passage 48. Intake manifold 44 and exhaust manifold 46 can selectively communicate with combustion chamber 30 via respective intake valves and exhaust valves (not shown). In some embodiments, combustion chamber 30 may include two or more intake valves and/or two or more exhaust valves.

Fuel injectors 50 are shown coupled directly to combustion chamber 30 for injecting fuel directly therein in proportion to the pulse width of signal FPW received from controller 12. In this manner, fuel injector 50 provides what is known as direct injection of fuel into combustion chamber 30. The fuel injector may be mounted in the side of the combustion chamber or in the top of the combustion chamber, for example. Fuel may be delivered to fuel injector 50 by a fuel system (not shown) including a fuel tank, a fuel pump, and a fuel rail. An example fuel system that may be employed in conjunction with engine 10 is described below with reference to FIG. 2. In some embodiments, combustion chambers 30 may alternatively, or additionally, include a fuel injector arranged in intake manifold 44 in a configuration that provides what is known as port injection of fuel into the intake port upstream from each combustion chamber 30. Intake passage 42 may include throttle 21 and 23 having throttle plates 22 and 24, respectively. In this particular example, the position of throttle plates 22 and 24 may be varied by controller 12 via signals provided to an actuator included with throttles 21 and 23. In one example, the actuators may be electric actuators (e.g., electric motors), a configuration that is commonly referred to as electronic throttle control (ETC). In this manner, throttles 21 and 23 may be operated to vary the intake air provided to combustion chamber 30 among other engine cylinders. The position of throttle plates 22 and 24 may be provided to controller 12 by throttle position signal TP. Intake passage 42 may further include a mass air flow sensor 120, a manifold air pressure sensor 122, and a throttle inlet pressure sensor 123 for providing respective signals MAF (mass airflow) MAP (manifold air pressure) to controller 12.

Exhaust passage 48 may receive exhaust gasses from cylinders 30. Exhaust gas sensor 128 is shown coupled to exhaust passage 48 upstream of turbine 62 and emission control device 78. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO, a NOx, HC, or CO sensor, for example. Emission control device 78 may be a three way catalyst (TWC), NOx trap, various other emission control devices, or combinations thereof.

Exhaust temperature may be measured by one or more temperature sensors (not shown) located in exhaust passage 48. Alternatively, exhaust temperature may be inferred based on engine operating conditions such as speed, load, AFR, spark retard, etc.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112, shown schematically in one location within the engine 10; a profile ignition pickup signal (PIP) from Hall effect sensor 118 (or other type) coupled to crankshaft 40; the throttle position (TP) from a throttle position sensor, as discussed; and absolute manifold pressure signal, MAP, from sensor 122, as discussed. Engine speed signal, RPM, may be generated by controller 12 from signal PIP. Manifold pressure signal MAP from a manifold pressure sensor may be used to provide an indication of vacuum, or pressure, in the intake manifold 44. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft 40. In some examples, storage medium read-only memory 106 may be programmed with computer readable data representing instructions executable by processor 102 for performing the methods described below as well as other variants that are anticipated but not specifically listed.

Engine 10 may further include a compression device such as a turbocharger or supercharger including at least a compressor 60 arranged along intake manifold 44. For a turbocharger, compressor 60 may be at least partially driven by a turbine 62, via, for example a shaft, or other coupling arrangement. The turbine 62 may be arranged along exhaust passage 48 and communicate with exhaust gasses flowing therethrough. Various arrangements may be provided to drive the compressor. For a supercharger, compressor 60 may be at least partially driven by the engine and/or an electric machine, and may not include a turbine. Thus, the amount of compression provided to one or more cylinders of the engine via a turbocharger or supercharger may be varied by controller 12. In some cases, the turbine 62 may drive, for example, an electric generator 64, to provide power to a battery 66 via a turbo driver 68. Power from the battery 66 may then be used to drive the compressor 60 via a motor 70. Further, a sensor 123 may be disposed in intake manifold 44 for providing a BOOST signal to controller 12.

Further, exhaust passage 48 may include wastegate 26 for diverting exhaust gas away from turbine 62. In some embodiments, wastegate 26 may be a multi-staged wastegate, such as a two-staged wastegate with a first stage configured to control boost pressure and a second stage configured to increase heat flux to emission control device 78. Wastegate 26 may be operated with an actuator 150, which may be an electric actuator such as an electric motor, for example, though pneumatic actuators are also contemplated. Intake passage 42 may include a compressor bypass valve 27 configured to divert intake air around compressor 60. Wastegate 26 and/or compressor bypass valve 27 may be controlled by controller 12 via actuators (e.g., actuator 150) to be opened when a lower boost pressure is desired, for example.

Intake passage 42 may further include charge air cooler (CAC) 80 (e.g., an intercooler) to decrease the temperature of the turbocharged or supercharged intake gasses. In some embodiments, charge air cooler 80 may be an air to air heat exchanger. In other embodiments, charge air cooler 80 may be an air to liquid heat exchanger.

Further, in the disclosed embodiments, an exhaust gas recirculation (EGR) system may route a desired portion of exhaust gas from exhaust passage 48 to intake passage 42 via EGR passage 140. The amount of EGR provided to intake passage 42 may be varied by controller 12 via EGR valve 142. Further, an EGR sensor (not shown) may be arranged within the EGR passage and may provide an indication of one or more of pressure, temperature, and concentration of the exhaust gas. Alternatively, the EGR may be controlled through a calculated value based on signals from the MAF sensor (upstream), MAP (intake manifold), MAT (manifold gas temperature) and the crank speed sensor. Further, the EGR may be controlled based on an exhaust $O_2$ sensor and/or an intake oxygen sensor (intake manifold). Under some conditions, the EGR system may be used to regulate the temperature of the air and fuel mixture within the combustion chamber. FIG. 1 shows a high pressure EGR system where EGR is routed from upstream of a turbine of a turbocharger to downstream of a compressor of a turbocharger. In other embodiments, the engine may additionally or alternatively include a low pressure EGR system where EGR is routed from downstream of a turbine of a turbocharger to upstream of a compressor of the turbocharger.

FIG. 2 shows a direct injection engine system 200, which may be configured as a propulsion system for a vehicle. The engine system 200 includes an internal combustion engine 202 having multiple combustion chambers or cylinders 204. Engine 202 may be engine 10 of FIG. 1, for example. Fuel can be provided directly to the cylinders 204 via in-cylinder direct injectors 206. As indicated schematically in FIG. 2, the engine 202 can receive intake air and exhaust products of the combusted fuel. The engine 202 may include a suitable type of engine including a gasoline or diesel engine.

Fuel can be provided to the engine 202 via the injectors 206 by way of a fuel system indicated generally at 208. In this particular example, the fuel system 208 includes a fuel storage tank 210 for storing the fuel on-board the vehicle, a lower pressure fuel pump 212 (e.g., a fuel lift pump), a higher pressure fuel pump 214, an accumulator 215, a fuel rail 216, and various fuel passages 218 and 220. In the example shown in FIG. 2, the fuel passage 218 carries fuel from the lower pressure pump 212 to the higher pressure fuel pump 214, and the fuel passage 220 carries fuel from the higher pressure fuel pump 214 to the fuel rail 216.

The lower pressure fuel pump 212 can be operated by a controller 222 (e.g., controller 12 of FIG. 1) to provide fuel to higher pressure fuel pump 214 via fuel passage 218. The lower pressure fuel pump 212 can be configured as what may be referred to as a fuel lift pump. As one example, lower pressure fuel pump 212 may be a turbine (e.g., centrifugal) pump including an electric (e.g., DC) pump motor, whereby the pressure increase across the pump and/or the volumetric flow rate through the pump may be controlled by varying the electrical power provided to the pump motor, thereby increasing or decreasing the motor speed. For example, as the controller 222 reduces the electrical power that is provided to pump 212, the volumetric flow rate and/or pressure increase across the pump may be reduced. The volumetric flow rate and/or pressure increase across the pump may be increased by increasing the electrical power that is provided to the pump 212. As one example, the electrical power supplied to the lower pressure pump motor can be obtained from an alternator or other energy storage device on-board the vehicle (not shown), whereby the control system can control the electrical load that is used to power the lower pressure pump. Thus, by varying the voltage and/or current provided to the lower pressure fuel pump, as indicated at 224, the flow rate and pressure of the fuel provided to higher pressure fuel pump 214 and ultimately to the fuel rail may be adjusted by the controller 222. In addition to providing injection pressure for direct injectors 206, pump 212 may provide injection pressure for one or more port fuel injectors (not shown in FIG. 2) in some implementations.

Low-pressure fuel pump 212 may be fluidly coupled to a filter 217, which may remove small impurities that may be contained in the fuel that could potentially damage fuel handling components. A check valve 213, which may facilitate fuel delivery and maintain fuel line pressure, may be positioned fluidly upstream of filter 217. With check valve 213 upstream of the filter 217, the compliance of low-pressure passage 218 may be increased since the filter may be physically large in volume. Furthermore, a pressure relief valve 219 may be employed to limit the fuel pressure in low-pressure passage 218 (e.g., the output from lift pump 212). Relief valve 219 may include a ball and spring mechanism that seats and seals at a specified pressure differential, for example. The pressure differential setpoint at which relief valve 219 may be configured to open may assume various suitable values; as a non-limiting example the setpoint may be 6.4 bar(g). An orifice check valve 221 may be placed in series with an orifice 223 to allow for air and/or fuel vapor to bleed out of the lift pump 212. In some embodiments, fuel system 208 may include one or more (e.g., a series) of check valves fluidly coupled to low-pressure fuel pump 212 to impede fuel from leaking back upstream of the valves. In this context, upstream flow refers to fuel flow traveling from fuel rail 216 towards low-pressure pump 212 while downstream flow refers to the nominal fuel flow direction from the low-pressure pump towards the fuel rail.

The higher pressure fuel pump 214 can be controlled by the controller 222 to provide fuel to the fuel rail 216 via the fuel passage 220. As one non-limiting example, higher pressure fuel pump 214 may be a BOSCH HDP5 HIGH PRESSURE PUMP, which utilizes a flow control valve (e.g., fuel volume regulator, magnetic solenoid valve, etc.) 226 to enable the control system to vary the effective pump volume of each pump stroke, as indicated at 227. However, it should be appreciated that other suitable higher pressure fuel pumps may be used. The higher pressure fuel pump 214 may be mechanically driven by the engine 202 in contrast to the motor driven lower pressure fuel pump 212. A pump piston 228 of the higher pressure fuel pump 214 can receive a mechanical input from the engine crank shaft or cam shaft via a cam 230. In this manner, higher pressure pump 214 can be operated according to the principle of a cam-driven single-cylinder pump. A sensor (not shown in FIG. 2) may be positioned near cam 230 to enable determination of the angular position of the cam (e.g., between 0 and 360 degrees), which may be relayed to controller 222. In some examples, higher pressure fuel pump 214 may supply sufficiently high fuel pressure to injectors 206. As injectors 206 may be configured as direct fuel injectors, higher pressure fuel pump 214 may be referred to as a direct injection (DI) fuel pump.

FIG. 2 depicts the optional inclusion of accumulator 215, introduced above. When included, accumulator 215 may be positioned downstream of lower pressure fuel pump 212 and upstream of higher pressure fuel pump 214, and may be configured to hold a volume of fuel that reduces the rate of fuel pressure increase or decrease between fuel pumps 212 and 214. The volume of accumulator 215 may be sized such that engine 202 can operate at idle conditions for a predetermined period of time between operating intervals of lower pressure fuel pump 212. For example, accumulator 215 can be sized such that when engine 202 idles, it takes one or more minutes to deplete pressure in the accumulator to a level at which higher pressure fuel pump 214 is incapable of maintaining a sufficiently high fuel pressure for fuel injectors 206. Accumulator 215 may thus enable an intermittent operation mode of lower pressure fuel pump 212 described below. In other embodiments, accumulator 215 may inherently exist in the compliance of fuel filter 217 and fuel line 218, and thus may not exist as a distinct element.

The controller 222 can individually actuate each of the injectors 206 via a fuel injection driver 236. The controller 222, the driver 236, and other suitable engine system controllers can comprise a control system. While the driver 236 is shown external to the controller 222, it should be appreciated that in other examples, the controller 222 can include the driver 236 or can be configured to provide the functionality of the driver 236. Controller 222 may include additional components not shown, such as those included in controller 12 of FIG. 1.

Fuel system 208 includes a low pressure (LP) fuel pressure sensor 231 positioned along fuel passage 218 between lift pump 212 and higher pressure fuel pump 214. In this configuration, readings from sensor 231 may be interpreted as indications of the fuel pressure of lift pump 212 (e.g., the outlet fuel pressure of the lift pump) and/or of the inlet pressure of higher pressure fuel pump. As described in further detail below, readings from sensor 231 may be used to assess the operation of various components in fuel system 208. LP fuel pressure sensor 231 may also be used to determine whether sufficient fuel pressure is provided to higher pressure fuel pump 214 so that the higher pressure fuel pump ingests liquid fuel and not fuel vapor, and/or to minimize the average electrical power supplied to lift pump 212. It will be understood that in other embodiments in which a port-fuel injection system, and not a direct injection system, is used, LP fuel pressure sensor 231 may sense both lift pump pressure and fuel injection. Further, while LP fuel pressure sensor 231 is shown as being positioned upstream of accumulator 215, in other embodiments the LP sensor may be positioned downstream of the accumulator.

As shown in FIG. 2, the fuel rail 216 includes a fuel rail pressure sensor 232 for providing an indication of fuel rail pressure to the controller 222. An engine speed sensor 234 can be used to provide an indication of engine speed to the controller 222. The indication of engine speed can be used to identify the speed of higher pressure fuel pump 214, since the pump 214 is mechanically driven by the engine 202, for example, via the crankshaft or camshaft.

In some cases, controller 222 may determine an expected or estimated fuel rail pressure and compare the expected fuel rail pressure to the measured fuel rail pressure measured by fuel rail pressure sensor 232. In other cases, controller 222 may determine an expected or estimated lift pump pressure (e.g., outlet fuel pressure from lift pump 212 and/or inlet fuel pressure into higher pressure fuel pump 214) and compare the expected lift pump pressure to the measured lift pump pressure measured by LP fuel pressure sensor 231. The determination and comparison of expected fuel pressures to corresponding measured fuel pressures may be performed periodically on a time basis at a suitable frequency or on an event basis. In either case, controller 222 may interpret a difference between an expected and a measured fuel pressure as an indication that operation of at least one component in fuel system 208 has degraded. As described in further detail below, various diagnostic tests may be performed to identify the particular cause of the deviation in fuel rail pressure, with various actions being potentially performed in response to identification of the cause.

In some implementations, controller 222 may determine the expected lift pump pressure based in part on operation of lift pump 212. Specifically, for embodiments in which lift pump 212 is a turbine pump driven by a DC motor, the lift pump may exhibit a highly affine (e.g., linear) correlation between the voltage supplied to the lift pump motor and the lift pump pressure.

Turning briefly to FIG. 3, a graph 300 illustrating lift pump voltage as a function of lift pump pressure is shown. Graph 300 particularly shows the highly affine correlation between the voltage supplied to a turbine lift pump (e.g., lift pump 212) driven by a DC electric motor and the lift pump pressure. An example data set generally indicated at 302, obtained in a testing environment specific to this type of lift pump, for example, and a function 304 fit to the data set are shown in graph 300. The data shown in graph 300 represents a minimum engine running fuel flow rate. As the fuel flow rate increases, the points increase in voltage. Function 304 may be stored in and accessed by controller 222 of FIG. 2 to inform control of fuel system 208—for example, if the voltage being supplied to lift pump 212 is known, it may be fed as an input to the function so that an expected or estimated lift pump pressure resulting from application of the supply voltage can be determined. In another example, a desired lift pump pressure may be fed to function 304 so that a lift pump voltage, whose application to lift pump 212 achieves the desired lift pump pressure, may be obtained. In particular, function 304 may be used to determine the lift pump voltages that achieve the extreme lift pump pressures—that is, the minimum and maximum achievable lift pump pressures. As described in further detail below, these extreme lift pump pressures may be achieved as part of various diagnostic routines employed to diagnose faults in fuel system 208. It will be understood, however, that the lift pump pressure minima and maxima may be bounded by fuel vapor pressure and a setpoint pressure of a pressure relief valve, respectively. It will also be appreciated that the values displayed in FIG. 3 are examples and are not intended to be limiting. Further, analogous data sets and functions relating lift pump pressure to lift pump voltage may be obtained and accessed for lift pump types other than turbine lift pumps driven by DC electric motors, including but not limited to positive displacement pumps and pumps driven by brushless motors. Such functions may assume linear or non-linear forms.

Returning to FIG. 2, determination of the expected lift pump pressure may also account for operation of fuel injectors 206 and/or higher pressure fuel pump 214. Particularly, the effects of these components on lift pump pressure may be parameterized by the fuel flow rate—e.g., the rate at which fuel is injected by injectors 206, which may be equal to the lift pump flow rate under steady state conditions. In some implementations, a linear relation may be formed between lift pump voltage, lift pump pressure, and fuel flow rate. As a non-limiting example, the relation may assume the following form: $V_{LP}=C_1*P_{LP}+C_2*F+C_3$, where $V_{LP}$ is the lift pump voltage, $P_{LP}$ is the lift pump pressure, F is the fuel flow rate, and $C_1$, $C_2$, and $C_3$ are constants which may respectively assume the values of 1.481, 0.026, and 2.147. In this example, the relation may be accessed to determine a lift pump supply voltage whose application results in a desired lift pump pressure and fuel flow rate. The relation may be stored in (e.g., via a lookup table) and accessed by controller 222, for example.

The expected fuel rail pressure in fuel rail 216 may be determined based on one or more operating parameters—for example, one or more of an assessment of fuel consumption (e.g., fuel flow rate, fuel injection rate), fuel temperature (e.g., via engine coolant temperature measurement), and lift pump pressure (e.g., as measured by LP fuel pressure sensor 231) may be used.

Thus, by determining an expected fuel pressure in the manners described above, controller 222 can compare the expected fuel pressure to the corresponding measured fuel pressure and interpret differences between the expected and measured pressures that are above a threshold difference as an indication of degradation in fuel system 208. In particular, a measured fuel rail pressure measured by fuel rail pressure sensor 232 may be compared to an expected fuel rail pressure, while a measured lift pump pressure measured by LP fuel pressure sensor 231 may be compared to an expected lift pump pressure. If, for example, controller 222 determines that the measured fuel rail pressure exceeds the expected fuel rail pressure by at least a threshold amount, the controller may interpret the difference as an indication that fuel rail pressure sensor 232 has degraded, as motor-driven fuel pump degradation does not typically create more pressure than expected. In response to interpreting that fuel rail pressure sensor 232 has degraded, controller 222 may apply open loop control by retrieving and applying a lift pump voltage corresponding to a desired lift pump pressure and fuel flow rate. This lift pump voltage may be retrieved by accessing the relation described above, for example. In some examples, the lift pump voltage may be modified (e.g., limited) to prevent or mitigate degradation in other components of fuel system 208, such as lift pump 212 and/or its associated motor. This approach may also be employed for the case in which a measured lift pump pressure exceeds an expected lift pump pressure by at least a threshold amount.

If, however, the measured fuel rail pressure is less than the expected fuel rail pressure by at least a threshold amount, controller 222 may be unable to definitively determine the source of degradation without further diagnostics, which may be performed even if the measured fuel rail pressure exceeds the expected fuel rail pressure by at least a threshold amount. For example, this difference between measured and expected fuel rail pressures may be the result of degraded fuel rail pressure sensor 232 operation and/or degradation in lift pump 212 (e.g., under-delivery of pressure). While the open loop control described above may be employed to select a lift pump voltage based on a desired lift pump pressure and fuel flow rate, the additional diagnostics may be performed to definitively identify the cause of the pressure difference. Identification of the cause may lead to alternative or additional actions in addition to the open loop control, as described in further detail below. Similarly, an inability to definitely identify the cause of a difference between a measured lift pump pressure and an expected lift pump pressure may arise if the measured lift pump pressure is less than the expected lift pump pressure by at least a threshold amount. As such, additional diagnostics may be performed in this case as well.

One such additional diagnostic may include driving lift pump 212 to achieve a maximum lift pump pressure and comparing the measured lift pump pressure to a pressure relief valve setpoint. In this example, lift pump 212 is driven to the point at which pressure relief valve 219 begins to limit the lift pump pressure so that the lift pump pressure does not exceed the pressure setpoint of the relief valve. As a non-limiting example illustrated by FIG. 3, the pressure setpoint may be 6.4 bar(g), so that driving lift pump 212 with 12V results in the maximum achievable lift pump pressure—6.4 bar(g). The effect of higher pressure fuel pump 214 operation on fuel pressure may be accounted for by, for example, deactivating the higher pressure fuel pump while comparing the measured lift pump pressure to the pressure relief valve setpoint.

Controller 222 may interpret measured lift pump pressures that exceed the pressure relief valve setpoint by a threshold amount as representative of degradation of LP fuel pressure sensor 231 or degradation in pressure relief valve 219 (e.g., clogging, sticking, etc.). Conversely, controller 222 may interpret measured lift pump pressures that fall below the pressure relief valve setpoint by a threshold amount as representative of degradation in pressure relief valve 219 (e.g., the valve is opening at pressure lower than the relief setpoint) or degradation in lift pump 212. As in this case the particular cause of deviation of measured lift pump pressure from expected lift pump pressure may not be definitively identified, additional diagnostics may be performed.

One such additional diagnostic may include bringing the fuel pressure in fuel system 208 to a vapor pressure corresponding to the fuel in the fuel system and comparing the measured lift pump pressure to the expected fuel vapor pressure. The fuel vapor pressure is the minimum pressure in fuel system 208 due to the presence of fuel; the fuel vapor pressure may be reached when higher pressure fuel pump 214 begins to ingest vapor or when fuel injectors 206 inject fuel until a ullage space forms, for example. To achieve the fuel vapor pressure, lift pump 212 may be deactivated for a suitable duration while higher pressure fuel pump 214 consumes a particular volume of fuel (e.g., 5 cc). The volume of fuel may be determined based on the compliance of lower pressure fuel plumbing, the initial fuel pressure in fuel system 208, and the expected fuel vapor pressure, which may be determined according to fuel temperature, for example.

Controller 222 may employ both the pressure relief setpoint and fuel vapor pressure diagnostics described above, respectively referred to herein as the "maximum pressure diagnostic" and the "minimum pressure diagnostic". If, after having employed both diagnostics, the measured lift pump pressure exceeds both the pressure relief setpoint and the fuel vapor pressure by respective thresholds amounts, controller 222 may determine that operation of LP fuel pressure sensor 231 is faulted. In this case, lift pump 212 may be controlled via the open loop approach described above. The same interpretation may be made if the measured lift pump pressure falls below both the pressure relief setpoint and the fuel vapor pressure by respective threshold amounts. Open loop lift control may also be applied for this scenario.

If, after application of the maximum and minimum pressure diagnostics, the measured lift pump pressure falls below the pressure relief setpoint by a threshold amount but exceeds the fuel vapor pressure by a threshold amount, controller 222 may be unable to definitively determine the cause of the measured pressure deviation. Accordingly, additional diagnostics may be performed. For example, the additional diagnostics may include deactivating higher pressure fuel pump 214 (e.g., by ceasing actuation of valve 226), allowing the fuel rail pressure to drop to a relatively low fuel pressure (e.g., a pressure near fuel vapor pressure), and pressurizing the fuel rail via lift pump 212. These three actions may occur when fuel system 208 is repressurized before engine cranking after engine 202 has cooled to ambient temperatures; as such this diagnostic may be performed at this time. In this example, the expected fuel rail pressure is equal to the lift pump pressure minus a pressure offset (e.g., 11 psi). If the measured fuel rail pressure is less than the lift pump pressure minus the pressure offset by a threshold amount, controller 222 may interpret this deviation as an indication that degradation in lift pump 212 has occurred. If on the other hand the measured fuel rail pressure is greater than the lift pump pressure minus the pressure offset by a threshold amount, controller 222 may interpret this deviation as an indication that degradation in LP fuel pressure sensor 231 has occurred. In this way, the cause of degradation in fuel system 208 may be definitively identified. Since this diagnostic involves determination of both fuel rail pressure and lift pump pressure, it may also be used to assess operation of fuel rail pressure sensor 232 (e.g., to determine whether or not the fuel rail pressure sensor is degraded).

Other diagnostics may be performed to identify faults in fuel system 208. For example, if the volumetric efficiency of higher pressure fuel pump 214 is below a threshold, LP fuel pressure sensor 231 may be considered degraded. In this case, higher pressure fuel pump 214 may be starting to ingest fuel vapor, causing the relatively low volumetric efficiency. This evaluation may be performed prior to the diagnostics described above. Alternatively or additionally, the voltage supplied to lift pump 212 may be adjusted by controller 222 and a determination made as to whether an expected corresponding change in fuel rail pressure occurred. The voltage adjustment may be a relatively small adjustment from the instant voltage supplied to lift pump 212, where the adjusted voltage may not be a maximum or minimum voltage (e.g., voltages corresponding that result in the fuel vapor pressure or relief pressure setpoint).

As alluded to above, the inclusion of accumulator 215 in fuel system 208 may enable intermittent operation of lift pump 212, at least during selected conditions. Intermittently operating lift pump 212 may include turning the pump on and off, where during off periods the pump speed falls to zero, for example. Intermittent lift pump operation may be employed to maintain the efficiency of higher pressure fuel pump 214 at a desired level, to maintain the efficiency of lift pump 212 at a desired level, and/or to reduce unnecessary energy consumption of lift pump 212. The efficiency (e.g., volumetric) of higher pressure fuel pump 214 may be at least partially parameterized by the fuel pressure at its inlet; as such, intermittent lift pump operation may be selected according to this inlet pressure, as this pressure may partially determine the efficiency of pump 214. The inlet pressure of higher pressure fuel pump 214 may be determined via LP fuel pressure sensor 231, or may be inferred based on various operating parameters. In other examples, the efficiency of pump 214 may be predicted based on the rate of fuel consumption by engine 202. The duration for which lift pump 212 is driven may be related to maintaining the inlet pressure of pump 214 above fuel vapor pressure, for example. On the other hand, lift pump 212 may be deactivated according to the amount of fuel (e.g., fuel volume) pumped to accumulator 215; for example, the lift pump may be deactivated when the amount of fuel pumped to the accumulator exceeds the volume of the accumulator by a predetermined amount (e.g., 20%). In other examples, lift pump 212 may be deactivated when the pressure in accumulator 215 or the inlet pressure of higher pressure fuel pump 214 exceed respective threshold pressures.

In some implementations, the operating mode of lift pump 212 may be selected according to the instant speed and/or load of engine 202. A suitable data structure such as a lookup table may store the operating modes which may be accessed by using engine speed and/or load as indices into the data structure, which may be stored on and accessed by controller 222, for example. The intermittent operating mode in particular may be selected for relatively lower engine speeds and/or loads. During these conditions, fuel flow to engine 202 is relatively low and lift pump 212 has capacity to supply fuel at a rate that is higher than the engine's fuel consumption rate. Therefore, lift pump 212 can fill accumulator 215 and then be turned off while engine 202 continues to operate (e.g., combusting air-fuel mixtures) for a period before the lift pump is restarted. Restarting lift pump 212 replenishes fuel in accumulator 215 that was fed to engine 202 while the lift pump was off.

During relatively higher engine speeds and/or loads, lift pump 212 may be operated continuously. In one embodiment, lift pump 212 is operated continuously when the lift pump cannot exceed the engine fuel flow rate by an amount (e.g., 25%) when the pump is operated at an "on" duty cycle (e.g., 75%) for a period of time (e.g., 1.5 minutes). However, if desired, the "on" duty cycle level that triggers continuous lift pump operation may be adjusted to various suitable percentages (e.g., 35%, 40%, 45%, 50%, 55%, 60%, 65%, 70%, etc.). In the continuous operating mode, lift pump 212 may be operated at a substantially constant voltage (e.g., 12V+/−0.2V), or the supply voltage may be modulated such that the pump speed can be controlled to deliver a desired pressure at the inlet of higher pressure fuel pump 214. If the supply voltage to lift pump 212 is modulated, the lift pump turns continuously without stopping between voltage pulses. Providing a narrowly spaced pulse train of voltage allows controller 222 to control pump flow so that lift pump flow essentially matches the amount of fuel being injected into engine 202. This operation can be accomplished by setting the lift pump duty cycle as a function of engine speed and load, for example. Alternatively, the average supply voltage to lift pump 212 from the modulated voltage can be varied as the amount of fuel supplied to engine 202 varies. In other embodiments, a controlled current output may be used to supply current to lift pump 212. The amount of current supplied to lift pump 212 can be varied with engine speed and load, for example.

Turning now to FIG. 4, a plot of representative signals of interest when operating a lift pump according to the intermittent operation mode described herein is shown. The lift pump whose operation is depicted in FIG. 4 may be lift pump 212 of FIG. 2, for example.

The signals begin on the left and move to the right. The X-axis represents time while the Y-axis of each individual graph corresponds to the labeled parameter. Vertical marker lines 401, 403, 405, 409, 411, and 413 identify various points of interest during the illustrated sequence. The sequence begins at the far left-hand side of FIG. 4. At this point, the engine (e.g., engine 202 of FIG. 2) is off and is then cold started (e.g., the engine has not been operated for a period of time and the engine temperature is substantially equal to ambient air temperature) shortly thereafter. During the starting process, the lift pump is commanded on. The lift pump is commanded on to ensure injection pump efficiency and to recharge the accumulator (e.g., accumulator 215 of FIG. 2). The engine begins to combust air-fuel mixtures causing the engine to accelerate. As engine speed increases and then stabilizes at idle speed, injector pump (e.g., higher pressure fuel pump 214 of FIG. 2) efficiency increases and the fuel rail pressure stabilizes at a level sufficient to support direct injection to the engine cylinders. Notice that the lift pump stays on even as the injector pump efficiency reaches a high level. This allows the lift pump to pressurize and fill the accumulator located downstream from the lift pump.

The lift pump is operated until it has filled the accumulator. Alternatively, the lift pump may be operated until a specified or predetermined level or volume of fuel is present in the accumulator. Then it is shut off, and the lift pump speed is reduced to zero. Fuel continues to be injected to the engine cylinders while the injection pump is off. The fuel rail pressure is maintained by pumping fuel from the accumulator to the fuel rail using the injection pump. The accumulator provides the injection pump fuel at a pressure that is near or higher than the fuel vapor pressure. As mentioned above, pressure at the injection pump inlet is one parameter by which the lift pump can be activated. In another embodiment, the lift pump efficiency is used to determine when to activate the lift pump. If the lift pump efficiency degrades, it indicates fuel vapor is forming at the pump inlet and lift pump pressure has to be increased to increase the injector pump efficiency.

As noted above, during low engine loads and speeds, the accumulator can provide enough fuel to idle the engine for a period of time. The amount of idle time between lift pump running events is related to the accumulator volume. However, it should be noted that increasing the accumulator volume may also increase the amount of time that it takes to charge the accumulator during a cold start. Accordingly, it is desirable to start the lift pump in anticipation of starting the engine. At vertical marker 401, engine speed and load begin to increase. Just before this event, injection pump efficiency and lift pump inlet pressure begin to be reduced. As described above, lift pump inlet pressure or injection pump efficiency can be used to determine when to restart the lift pump. In one example, when lift pump inlet pressure reaches a predetermined level, the lift pump is restarted. In another example, when injection pump efficiency reaches a predetermined level, the lift pump is restarted. The lift pump is deactivated after it is determined that the accumulator has been filled, or at least filled to a predetermined level or volume. The deactivated lift pump coasts to a stop where it waits to be restarted.

The fuel rail pressure is substantially constant during the engine idle period and is increased slightly as the engine speed and load are increased. Since engine cylinder pressure increases with engine load, increasing the fuel rail pressure allows fuel to be injected into engine cylinders as cylinder pressure increases. Further, increasing fuel rail pressure with engine speed also allows a cylinder to be fueled within a certain crankshaft angle. As engine speed increases, the amount of time it takes the engine to rotate through a given crankshaft angle decreases. By increasing fuel pressure, equivalent fuel amounts may be injected within a particular crankshaft window even though engine speed has increased from one engine operating condition to another.

Between vertical markers 401 and 403, engine speed and load are gradually increased and the lift pump is restarted to replenish fuel that is pulled from the accumulator and injected to the engine. Also notice that the interval between lift pump restarts is reduced and that the time that the lift pump is on is increased. Operating the engine at higher speeds and loads increases engine fuel consumption and empties the accumulator at a faster rate. And since fuel is being injected to the engine while the accumulator is filled, it takes longer for the lift pump to fill the accumulator.

Engine speed and load are reduced to the left of vertical marker 403; this load reduction increases the time between lift pump "on" intervals and reduces the amount of time necessary for the lift pump to fill the accumulator. Fuel rail pressure is also reduced because less injection pressure is necessary at lower engine loads.

At vertical marker 405, engine speed and load are once again increased. Shortly thereafter, the lift pump is restarted to replenish fuel extracted from the accumulator. The fuel pump is restarted again before vertical marker 409 in a continuous operation mode. In one example, this mode is triggered by operating the engine above predetermined engine speed and load levels. In this mode, the lift pump continues to rotate without being deactivated and without returning to zero speed. The fuel rail pressure is also increased so that fuel can be directly injected to engine cylinders while the cylinders are operated at higher speeds and loads.

It should be noted that the fuel pump command voltage may be modulated at a frequency and duty cycle that increases or decreases lift pump efficiency without deactivating the lift pump and sending the pump to zero speed during continuous operating mode. In this way, the lift pump output may be regulated such that the lift pump flow rate substantially matches the amount of fuel being injected to the engine (e.g., engine fuel flow and lift pump fuel flow rates may be within ±10% of each other).

At vertical marker 409, engine load is decreased and the lift pump is deactivated. The engine also returns to an idle condition where the lift pump is operated intermittently in response to injection pump efficiency or lift pump inlet pressure.

Between vertical markers 411 and 413, engine speed and load are increased. Similar to the interval between markers 401 and 403, the time between lift pump "on" events is decreased and the lift pump "on" time is increased. Again, this permits the lift pump to meet the engine's increased fuel requirements.

After marker 413, the engine speed and load are decreased and the engine returns to an idle condition. At idle, the lift pump "off" interval is increased and the lift pump "on" time is decreased to reflect the engine's lower fuel consumption during these conditions.

Returning to FIG. 2, in some embodiments the pulse durations fed to lift pump 212 may be selected to learn the minimum and maximum fuel pressures in fuel passage 218 if desired—that is, to learn the fuel vapor and relief setpoint pressures. Thus, after an "on" pulse, an expected pressure in fuel passage 218 (or in another location) may become the relief setpoint pressure, while, after a duration following termination of the "on" pulse, the expected pressure becomes the fuel vapor pressure. In other embodiments lift pump 212 may be intermittently operated for predetermined time periods rather than according to pressure or efficiency conditions. For example, lift pump 212 may be operated in the pulsed intermittent operation mode for a discrete time duration (e.g., 200 ms) only upon detection that a threshold fuel volume (e.g., 3 cc) has been expelled by higher pressure fuel pump 214. Lift pump operation may be switched to the continuous operation mode when vapor pressure is detected at the inlet of higher pressure fuel pump 214. Alternatively, the pulsed intermittent operation mode may be selected for the discrete time duration only upon detection that a threshold fuel volume has been injected into engine 202. In some implementations, a predetermined pulse duration may be supplied to lift pump 212 upon detection of vapor, with the predetermined pulse repeatedly fed to the lift pump until vapor is no longer detected. This approach may be implemented via open loop control, for example.

The intermittent lift pump operation mode described herein may increase the efficiency of lift pump operation, in turn increasing fuel economy of an associated engine. Specifically, lift pump 212, when controlled intermittently, may be operated in a region of increased efficiency (e.g., within 90% of rated efficiency). This region may correspond to a relatively higher region of fuel flow rates that can be achieved with lift pump 212. Operating lift pump 212 in this region can reduce engine fuel consumption since the engine has to produce less electricity to operate the lift pump and because the lift pump fills accumulator 215 quicker when operated at these conditions, for example. Moreover, modulation of the supply voltage fed to lift pump 212 may increase efficiency when the pump is operated continuously.

The intermittent lift operation mode may also be used synergistically in combination with one or more of the diagnostics described above. For example, some, and in some embodiments all, pulses delivered to lift pump 212 during intermittent operation may drive the fuel pressure in fuel passage 218 (and in some examples the inlet pressure of higher pressure fuel pump 214) to the pressure relief setpoint established by pressure relief valve 219. As such, the maximum pressure diagnostic may be performed each time such a pulse is issued to lift pump 212, though in some examples the operation of higher pressure fuel pump 214 may be accounted for. In some examples, a pulse may not be issued to lift pump 212 until the fuel vapor pressure is approximately reached. As such, the minimum pressure diagnostic may be performed at these times. Moreover, the diagnostic in which the supply voltage fed to lift pump 212 is adjusted to a non-extreme (e.g., not a maximum or minimum supply voltage) value and a corresponding change in fuel rail pressure sought may be performed each time a pulse is fed to the lift pump. As such, intermittent lift pump operation may enable frequent performance of these diagnostics, providing robust monitoring of the state of fuel system 208.

It will be appreciated, however, that embodiments in which lift pump 212 is not operated intermittently are within the scope of this disclosure. In this example, accumulator 215 may be omitted from fuel system 208, yet one or more of the diagnostics described above may still be performed, though during selected conditions conducive to their performance.

FIGS. 5A and 5B show a flowchart illustrating a routine 500 for identifying degradation in a fuel system. With reference to FIG. 2, routine 500 may be stored on and executed by controller 222 to identify degradation in fuel system 208, for example. Generally, routine 500 may include one or more diagnostic routines in which an expected fuel pressure is determined, a lift pump is driven to the expected fuel pressure, and a measured fuel pressure is compared to the expected fuel pressure. Degradation in the fuel system may then be identified based on the comparison.

Routine 500 may include performing a first diagnostic 501, which may include steps 502, 504, and 506.

At 502 of the routine, the lift pump pressure in the fuel system is measured, for example via LP fuel pressure sensor 231 of FIG. 2.

At 504 of the routine, the expected lift pump pressure is determined. The expected lift pump pressure may be determined according to the type of lift pump in the fuel system. As described above, for embodiments in which the lift pump is a turbine pump driven by a DC electric motor, the expected lift pump pressure may be determined according to a linear relation relating expected lift pump pressure to lift pump supply voltage and fuel flow rate. However, linear or non-linear relations for other types of lift pumps may be used, and in other embodiments, the expected lift pump pressure may be determined in other manners.

At 506 of the routine, it is determined whether the absolute value of the difference between the measured lift pump pressure and the expected lift pump pressure exceeds a threshold difference. If the difference does not exceed the threshold difference (NO), the routine ends. In this case, the fuel system may be controlled nominally and operation of the fuel system may be assumed to be nominal (e.g., degradation in the fuel system is not interpreted). If the difference does exceed the threshold difference (YES), the routine proceeds to a second diagnostic 507, which may include steps 508, 510, 512, 514, and 516. In this case, degradation in the fuel system may be assumed to have occurred. It will be appreciated that first diagnostic 501 may be performed on a relatively persistent basis throughout engine operation, as long as lift pump pressure can be measured and expected lift pump pressure can be determined.

At 508 of the routine, the lift pump is driven high to achieve the relief setpoint pressure. In other words, the lift pump is driven with a voltage that causes a pressure relief valve to limit the lift pump pressure to its setpoint pressure. As described above, for implementations in which the lift pump is driven with intermittent pulses, driving the lift pump high may correspond to one or more, if not all, such pulses.

At 510 of the routine, operation of a higher pressure fuel pump (e.g., direct injection fuel pump) downstream the lift pump may be optionally accounted for. This may include considering the fuel flow rate (e.g., fuel injection rate) and/or speed of the higher pressure fuel pump (e.g., by determining engine speed), or in some embodiments deactivating the higher pressure fuel pump during selected conditions (e.g., during DFSO).

At 512 of the routine, it is determined whether the measured lift pump pressure exceeds, is less than, or is within range of the relief setpoint pressure. If the measured lift pump pressure exceeds the relief setpoint pressure (EXCEEDS), a fault in the LP fuel pressure sensor, fuel rail pressure sensor, and/or pressure relief valve is assumed at 514. If the measured lift pump pressure is less than the relief setpoint pressure (LESS THAN) or is within range (e.g., within 0.5 Bar(g)) of the relief setpoint pressure (IN RANGE), a fault in one or more of the LP fuel pressure sensor, fuel rail pressure sensor, pressure relief valve, and lift pump is assumed at 516.

In either case, the routine proceeds to a third diagnostic 517, which may include steps 518, 520, 522, 524, and 526. It will be appreciated that the determination performed at 512 may include determining whether the measured lift pump pressure exceeds or is less than the relief setpoint pressure by respective thresholds.

At 518 of the routine, the lift pump is deactivated (e.g., the supply of pulses to the lift pump is ceased). In some examples, the lift pump is deactivated to achieve the fuel vapor pressure. For example, the lift pump may be deactivated for a suitable duration while the higher pressure fuel pump consumes a particular volume of fuel (e.g., 5 cc). The volume of fuel may be determined based on the compliance of the lift pump, the initial fuel pressure in fuel system, and the expected fuel vapor pressure, which may be a function of temperature, for example. The fuel vapor pressure may be reached when the higher pressure fuel pump begins to ingest vapor or when the fuel injectors inject fuel until a ullage space forms, for example. In some embodiments in which the lift pump is intermittently pulsed, the fuel vapor pressure may be achieved after a duration following the supply of a pulse to the lift pump. The duration is sufficiently long enough to allow fuel pressure to drop to the fuel vapor pressure.

At 522 of the routine, it is determined whether the measured lift pump pressure exceeds, is less than, or is in range of both the fuel vapor pressure and the relief setpoint pressure. If the measured lift pump pressure exceeds both, or is less than both, the fuel vapor pressure and the relief setpoint pressure (YES), the routine proceeds to 524 where a fault in the LP fuel pressure sensor is assumed. At 526 of the routine, open loop control is applied to the lift pump to compensate the sensor fault. This may include retrieving a lift pump supply voltage from a data structure that relates lift pump supply voltages to lift pump pressures, potentially in addition to other parameters such as fuel flow rate. Further, in some examples the retrieved lift pump supply voltage may be modified to prevent or mitigate degradation in other components of the fuel system. Following 526, the routine ends.

If the measured lift pump pressure does not exceed, is not less than, or is in range (e.g., within 0.5 Bar(g)) of both the fuel vapor pressure and the relief setpoint pressure (NO), the routine proceeds to 528 in a fourth diagnostic 527 in an attempt to distinguish among the potential faults in the fuel system and definitively identify the particular fault in the fuel system. Fourth diagnostic 527 may include steps 528, 530, 532, 534, 536, 538, 540, and 542.

At 528 of the routine, it is determined whether operating conditions are suitable for fourth diagnostic 527. For example, suitable conditions may include those in which the engine has cooled to ambient temperatures, and repressurization of the fuel system may be performed. If the operating conditions are not suitable for fourth diagnostic 527 (NO), the routine returns to 528. If the operating conditions are suitable for fourth diagnostic 527 (YES), the routine proceeds to 530 where the higher pressure fuel pump is deactivated.

At 532 of the routine, the fuel rail pressure is allowed to drop to a relatively low pressure. At 534 of the routine, the fuel rail is pressurized via the lift pump. In some examples, the lift pump may be controlled such that its maximum output results, in turn resulting in maximum fuel rail pressure with the higher pressure fuel pump deactivated. Here, the expected fuel rail pressure becomes the lift pump pressure minus a pressure offset (e.g., 11 psi). As such, it is determined at 536 whether the fuel rail pressure exceeds, is less than, or is within range (e.g., within 0.5 Bar(g)) of the lift pump pressure minus the pressure offset. If the fuel rail pressure exceeds the lift pump pressure minus the pressure offset (EXCEEDS), the routine proceeds to 538 where it is determined whether the lift pump pressure exceeded the relief setpoint pressure as determined at 512. If the lift pump pressure exceeded the relief setpoint pressure (YES), a fault in the pressure relief valve is assumed at 540. If the lift pump pressure did not exceed the relief setpoint pressure (NO), a fault in the fuel rail pressure sensor is assumed at 542. In either case, following 540 and 542, the routine proceeds to 544 where open loop control is applied to the lift pump.

The nature of open loop control may vary depending on which component is identified as being the cause of degradation in the fuel system. For example, open loop control of the lift pump may target a relatively high lift pump pressure above the estimated fuel vapor pressure. Such an approach may be used for embodiments in which direct fuel injection, and not port fuel injection, is employed, for example. In another example, open loop control may drive the lift pump to a lift pump pressure slightly above the relief setpoint pressure (e.g., 0.2 Bar(g) thereabove). This approach may be used for embodiments in which direct injection and port fuel injection is employed, for example. In yet another example, open loop control may include pulsing the lift pump according to the intermittent operation mode, using suitable pulse and inter-pulse durations. As a non-limiting example, the lift pump may be pulsed with 12 volts for 200 ms every time 3 cc of fuel is consumed. In some embodiments, feedback may be employed such that the lift pump is controlled according to the volumetric efficiency of the higher pressure fuel pump. This approach may be utilized for embodiments in which direct injection, and not port fuel injection, is employed, for example.

If it is determined at 536 that the fuel rail pressure is less than the lift pump pressure minus the pressure offset (LESS THAN), the routine proceeds to 546 where it is determined whether the lift pump pressure was less than the relief setpoint pressure as determined at 512. If the lift pump pressure was less than the relief setpoint pressure (YES), a fault in the pressure relief valve is assumed at 548. If the lift pump pressure was not less than the relief setpoint pressure (NO), a fault in the fuel rail pressure sensor is assumed at 550. In either case, following 548 and 550, the routine proceeds to 544 where open loop control is applied to the lift pump as described above.

If it is determined at 536 that the fuel rail pressure is in range of the lift pump pressure minus the pressure offset (IN RANGE), the routine proceeds to 552 where a fault in the lift pump is assumed. Following 552, the routine proceeds to 544 where open loop control is applied to the lift pump as described above. Following 544, the routine ends. In some examples of open loop lift pump control, a lift pump supply voltage may be selected in the manners described above, though the selected supply voltage may be modified to compensate degradation in the fuel pump. In some examples, this modification may be related (e.g., proportional) to the degree to which an expected fuel pressure deviates from a measured fuel pressure (e.g., the extent to which the fuel rail pressure deviates from the lift pump pressure minus the constant); for example, the selected supply voltage may be increased according to the degree of such deviation.

Various modifications may be made to routine 500 without departing from the scope of this disclosure. For example, when degradation in the fuel system is definitively identified and attributed to a particular cause, the degradation may be indicated in various manners, such as via a dashboard indicator, setting a diagnostic code, etc. Further, routine 500 may be modified to perform the diagnostic described above in which a perturbation to the lift pump supply voltage to a non-extreme value, and a determination made as to whether a corresponding pressure change is observed. This diagnostic may be performed following first diagnostic 501, for example, and may be employed in conjunction with the LP fuel pressure sensor and/or the fuel rail pressure sensor. Still further, a limp home engine operating mode may be engaged in response to fault identification in which engine output is limited. Yet further, additional approaches may be employed to identifying fault in the fuel rail pressure sensor. For example, electrical resistance or impedance sensing of the LP fuel pressure sensor and/or fuel rail pressure sensor may be performed to determine whether the measured resistances or impedances are within predetermined ranges indicative of a degraded or non-degraded state of the sensors.

FIG. 6 shows a plot 600 illustrating operation of a fuel system when in a diagnostic mode and a non-diagnostic mode. The fuel system may be fuel system 208 of FIG. 2, for example.

Plot 600 specifically shows graphs of the supply voltage supplied to a lift pump and lift pump pressure, both as a function of time. With reference to FIG. 2, the lift pump may be lift pump 212, while the lift pump pressure may correspond to the outlet pressure of the lift pump indicated by LP fuel pressure sensor 231 for example. From the start of plot 600 (e.g., time $t_0$) to a time the lift pump is intermittently actuated with pulses, for example responsive to lift pump inlet pressure and/or injection pump (e.g., volumetric) efficiency, in the non-diagnostic mode in the non-diagnostic mode, identification of degradation in the fuel system is not desired, and the lift pump is driven such that extreme fuel pressures—namely, the relief setpoint pressure and the fuel vapor pressure—do not occur. Rather, as depicted in FIG. 6, lift pump pressure is maintained between, and not equal to, the relief setpoint and fuel vapor pressures (below and above, respectively). Following $t_1$, however, identification of degradation in the fuel system is desired. As such, the fuel system is operated in the diagnostic mode. While the lift pump is still operated intermittently via pulsing, the pulses used to drive the lift pump are selected to achieve the relief setpoint pressure (via application of a pulse) and the fuel vapor pressure (via non-application of a pulse for a suitable duration). In this example, the duration of pulses applied during the diagnostic period (e.g., from time $t_1$ to time $t_2$), is increased relative to the duration of pulses applied during the non-diagnostic periods (from time $t_0$ to time $t_1$, and from time $t_2$ to a time $t_3$). As such, the corresponding diagnostics described above may be performed for the three instances at which the fuel vapor pressure is reached and for the three instances at which the relief setpoint pressure is achieved. At time $t_2$, until time $t_3$, diagnostic operation is ceased and non-diagnostic operation is returned to, As such, intermittent Lift pump operation continues but in such a manner as to avoid the relief setpoint and fuel vapor pressures. The diagnostic period may have ceased due to sufficient identification of degradation in the fuel system, or because operating conditions ceased to be conducive to diagnosis, for example. It will be appreciated that FIG. 6 is provided as an example and is not intended to be limiting. In particular, the form and appearance of the pulses and pressures shown in FIG. 6 are exemplary, Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method of operating a fuel system, comprising:

applying a pulse to a fuel pump responsive to detecting that lift pump pressure corresponds to a fuel vapor pressure;

ceasing application of the pulse responsive to detecting that the lift pump pressure corresponds to a relief setpoint pressure; and indicating degradation in the fuel system if the detected lift pump pressure deviates from an expected lift pump pressure, including distinguishing among degradation in the fuel pump, a lower pressure fuel pressure sensor, a fuel rail pressure sensor, and a pressure relief valve.

2. The method of claim 1, wherein the expected lift pump pressure is determined based on a voltage supplied to the fuel pump and a fuel flow rate.

3. The method of claim 1, wherein the expected lift pump pressure is the fuel vapor pressure.

4. The method of claim 1, wherein the expected lift pump pressure is the relief setpoint pressure, and wherein indicating degradation in the fuel system includes:

if the detected lift pump pressure exceeds the relief setpoint pressure, assuming a fault in the lower pressure fuel pressure sensor, the fuel rail pressure sensor, and/or the pressure relief valve; and if the detected lift pump pressure is less than the relief setpoint pressure, assuming a fault in the fuel rail pressure sensor, the lower pressure fuel pressure sensor, the pressure relief valve, and/or the fuel pump.

5. The method of claim 1, further comprising:

after ceasing application of the pulse, operating a higher pressure fuel pump downstream of the fuel pump until the fuel vapor pressure is reached; and comparing the lift pump pressure to the fuel vapor pressure and the relief setpoint pressure.

6. The method of claim 5, wherein indicating degradation in the fuel system includes:

if the lift pump pressure exceeds, is less than, or is within a range of both the fuel vapor pressure and the relief setpoint pressure, indicating degradation in the lower pressure fuel pressure sensor; and if the lift pump pressure does not exceed, is not less than, or is not within the range of both the fuel vapor pressure and the relief setpoint pressure, performing a diagnostic during selected conditions.

7. The method of claim 6, further comprising after indicating degradation in the lower pressure fuel pressure sensor, applying open loop control to the fuel pump based on a desired pressure.

8. The method of claim 6, wherein performing the diagnostic includes:

deactivating the higher pressure fuel pump;

after the fuel rail pressure approximately reaches the fuel vapor pressure, pressurizing a fuel rail to an expected fuel rail pressure by applying the pulse to the fuel pump, the expected fuel rail pressure being the lift pump pressure minus a constant;

if the fuel rail pressure exceeds or is less than the expected pressure, indicating fault in one of the fuel rail pressure sensor and the pressure relief valve; and if the fuel rail pressure is within the range of the expected pressure, indicating fault in the fuel pump.

9. The method of claim 8, further comprising applying open loop control to the fuel pump based on a desired pressure.

10. A method of operating a fuel system, comprising:

determining an expected pressure;

performing a first diagnostic by driving a lift pump in the fuel system to the expected pressure and comparing a measured pressure to the expected pressure, the lift pump driven according to an intermittent operation mode; and identifying degradation in the fuel system based on the comparison.

11. The method of claim 10, wherein the comparison includes determining a difference between the measured pressure and the expected pressure, the method further comprising:

if the difference exceeds a threshold, performing a second diagnostic by driving the lift pump to a relief setpoint pressure;

comparing a lift pump pressure to the relief setpoint pressure; and identifying degradation in the fuel system based on the comparison of the lift pump pressure to the relief setpoint pressure.

12. The method of claim 11, wherein identifying degradation in the fuel system based on the comparison of the lift pump pressure to the relief setpoint pressure includes:

if the lift pump pressure exceeds the relief setpoint pressure, assuming a fault in a lower pressure fuel pressure sensor, a fuel rail pressure sensor, and/or a pressure relief valve; and if the lift pump pressure is less than the relief setpoint pressure, assuming a fault in the lower pressure fuel pressure sensor, the fuel rail pressure sensor, the pressure relief valve, and/or the lift pump.

13. The method of claim 11, further comprising:

performing a third diagnostic by deactivating the lift pump;

operating a higher pressure fuel pump downstream of the lift pump until a fuel vapor pressure is reached; and comparing the lift pump pressure to the fuel vapor pressure and the relief setpoint pressure.

14. The method of claim 13, further comprising:

if the lift pump pressure exceeds, is less than, or is within a range of both the fuel vapor pressure and the relief setpoint pressure, indicating degradation in the lower pressure fuel pressure sensor; and if the lift pump pressure does not exceed, is not less than, or is not within the range of both the fuel vapor pressure and the relief setpoint pressure, performing a fourth diagnostic during selected conditions.

15. The method of claim 13, wherein performing the fourth diagnostic includes:

deactivating the higher pressure fuel pump;

after a fuel rail pressure approximately reaches the fuel vapor pressure, pressurizing a fuel rail to the expected pressure, the expected pressure being the lift pump pressure minus a constant; and identifying degradation in the fuel system based on a comparison of the fuel rail pressure to the expected pressure.

16. The method of claim 15, further comprising:

if the fuel rail pressure exceeds the expected pressure, indicating fault in one of the fuel rail pressure sensor and the pressure relief valve; and applying open loop control to the lift pump based on a desired pressure.

17. The method of claim 15, further comprising:

if the fuel rail pressure is less than the expected pressure, indicating fault in one of the fuel rail pressure sensor and the pressure relief valve;

if the fuel rail pressure is within the range of the expected pressure, indicating fault in the lift pump; and applying open loop control to the lift pump based on a desired pressure.

18. The method of claim 10, wherein in the intermittent mode the lift pump is pulsed on and off responsive to a fuel volume pumped to an accumulator positioned between the lift pump and a higher pressure fuel pump downstream of the lift pump, and wherein the lift pump is pulsed such that, after an on pulse, the expected pressure becomes a relief setpoint pressure, the relief setpoint pressure being a pressure at which a pressure relief valve limits output from the lift pump, and after a duration following termination of the on pulse, the expected pressure becomes a fuel vapor pressure.

19. A method of operating a fuel system, comprising:

identifying degradation in the fuel system by performing at least one diagnostic in which a lift pump of the fuel system is driven to an expected pressure and a measured pressure is compared to the expected pressure, the lift pump driven according to an intermittent operation mode.

20. The method of claim 19, wherein the expected pressure is one of a maximum relief setpoint pressure at which a pressure relief valve limits output from the lift pump and a minimum fuel vapor pressure.

* * * * *